US012779314B2

(12) United States Patent
Kloster et al.

(10) Patent No.: US 12,779,314 B2
(45) Date of Patent: Nov. 3, 2026

(54) SPLITBOARD JOINING DEVICE

(71) Applicants: Bryce M. Kloster, Issaquah, WA (US); Tyler G. Kloster, North Bend, WA (US)

(72) Inventors: Bryce M. Kloster, Issaquah, WA (US); Tyler G. Kloster, North Bend, WA (US)

( * ) Notice: Subject to any disclaimer, the term of this patent is extended or adjusted under 35 U.S.C. 154(b) by 311 days.

(21) Appl. No.: 18/615,731

(22) Filed: Mar. 25, 2024

(65) Prior Publication Data

US 2024/0226704 A1 Jul. 11, 2024

Related U.S. Application Data

(63) Continuation of application No. 17/675,412, filed on Feb. 18, 2022, now Pat. No. 11,938,394.

(60) Provisional application No. 63/152,153, filed on Feb. 22, 2021.

(51) Int. Cl.
*A63C 5/02* (2006.01)

(52) U.S. Cl.
CPC ..... *A63C 5/02* (2013.01)

(58) Field of Classification Search
CPC ..... Y10T 24/00; A63C 5/02; A63C 2203/06; A63C 5/03; A63C 5/031; A63C 5/033; A63C 5/16; A63C 2203/10; Y10S 292/49
See application file for complete search history.

(56) References Cited

U.S. PATENT DOCUMENTS

| | | | |
|---|---|---|---|
| 31,259 | A | 1/1861 | Rich |
| 1,473,011 | A | 11/1923 | Christophel |
| 1,477,692 | A | 12/1923 | Christophel |
| 2,660,812 | A | 12/1953 | Henke |
| 3,061,325 | A | 10/1962 | Glass |
| 3,171,667 | A | 3/1965 | Wightman |
| 3,439,928 | A | 4/1969 | Noguchi |

(Continued)

FOREIGN PATENT DOCUMENTS

| | | | |
|---|---|---|---|
| CH | 681 509 A5 | | 4/1993 |
| CN | 2277854 Y | * | 4/1998 |

(Continued)

OTHER PUBLICATIONS

CN-2277854-Y English Translation (Year: 1998).*

(Continued)

*Primary Examiner* — Michael T. Walsh
(74) *Attorney, Agent, or Firm* — Knobbe, Martens, Olson & Bear, LLP

(57) ABSTRACT

The present disclosure relates to splitboard joining devices. The splitboard joining devices can quickly and easily join the skis of a splitboard to create a snowboard. The devices can clamp the splitboard skis in a direction perpendicular and parallel to the seam of the splitboard and normal to the top surface of the splitboard skis. This can prevent the splitboard skis from moving up and down relative to each other, moving apart in a direction perpendicular to the seam, sliding relative to each other in a direction parallel to the seam, and rotating about the seam. The splitboard joining devices can constrain rotation and movement about the seam of the splitboard to make a splitboard ride like a normal snowboard and enhance a rider's experience on a splitboard.

8 Claims, 10 Drawing Sheets

(56) References Cited

U.S. PATENT DOCUMENTS 3,506,279 A 4/1970 Lambert
3,593,356 A 7/1971 Schmalfeldt
3,596,918 A * 8/1971 Masuda ..... A63C 5/02 403/339
3,627,349 A 12/1971 Barry
3,677,566 A 7/1972 Lawrence
3,782,745 A 1/1974 Stoveken
3,861,698 A 1/1975 Greig
4,022,491 A 5/1977 Powell
4,062,553 A 12/1977 Riedel
4,085,528 A 4/1978 Delery
4,138,128 A 2/1979 Criss
4,163,565 A 8/1979 Weber
4,190,970 A 3/1980 Annovi
4,221,394 A 9/1980 Campbell
4,275,904 A 6/1981 Pedersen
4,403,785 A 9/1983 Hottel
4,428,608 A 1/1984 Cooke et al.
4,473,235 A 9/1984 Burt
4,547,981 A 10/1985 Thais et al.
4,652,007 A 3/1987 Dennis
4,700,967 A 10/1987 Meatto et al.
4,705,308 A 11/1987 Bisbing
4,728,116 A 3/1988 Hill
4,741,550 A 5/1988 Dennis
4,770,441 A 9/1988 Demonsant et al.
4,817,988 A 4/1989 Chauvet et al.
4,856,808 A 8/1989 Longoni
4,871,337 A 10/1989 Harris
4,949,479 A 8/1990 Ottieri
4,951,960 A 8/1990 Sadler
4,955,632 A 9/1990 Giarritta et al.
4,973,073 A 11/1990 Raines et al.
4,979,760 A 12/1990 Derrah
4,982,733 A 1/1991 Broadhurst et al.
5,028,068 A 7/1991 Donovan
5,035,443 A 7/1991 Kincheloe
5,044,654 A 9/1991 Meyer
5,065,530 A 11/1991 Pozzobon et al.
5,065,533 A 11/1991 Paris
5,069,463 A 12/1991 Baud et al.
5,109,616 A 5/1992 Lush
5,145,202 A 9/1992 Miller
5,156,644 A 10/1992 Koehler et al.
5,249,816 A 10/1993 Southworth
5,299,823 A 4/1994 Glaser
5,344,179 A 9/1994 Fritschi et al.
5,397,150 A 3/1995 Commier et al.
5,462,318 A 10/1995 Cooke
5,499,461 A 3/1996 Danezin et al.
5,542,197 A 8/1996 Vincent
5,551,728 A 9/1996 Barthel et al.
5,553,883 A 9/1996 Erb
5,558,354 A 9/1996 Lion
5,570,522 A 11/1996 Olson et al.
5,618,051 A 4/1997 Kobylenski et al.
5,649,722 A 7/1997 Champlin
5,660,416 A 8/1997 Schiele et al.
5,697,631 A 12/1997 Ratzek et al.
5,701,689 A 12/1997 Hansen et al.
5,713,587 A 2/1998 Morrow et al.
5,741,023 A 4/1998 Schiele et al.
5,762,358 A 6/1998 Hale
5,765,853 A 6/1998 Erb
5,771,609 A 6/1998 Messmer
5,815,952 A 10/1998 Bobrowicz
5,816,590 A 10/1998 Fey et al.
5,820,139 A 10/1998 Grindl
5,884,933 A 3/1999 Trott
5,887,886 A 3/1999 Bourdeau
5,894,684 A 4/1999 Sand et al.
5,901,469 A 5/1999 Saillet
5,906,388 A 5/1999 Neiley
5,909,886 A 6/1999 Tugutaka et al.
5,937,546 A 8/1999 Messmer
5,941,552 A 8/1999 Beran
5,947,487 A 9/1999 Keleny et al.
5,966,843 A 10/1999 Sand et al.
5,966,844 A 10/1999 Hellerman et al.
5,979,082 A 11/1999 Pallatin
5,984,324 A 11/1999 Wariakois
5,984,325 A 11/1999 Acuna
6,000,711 A 12/1999 Fey et al.
6,015,161 A 1/2000 Carlson
6,041,721 A * 3/2000 Weston ..... E05C 19/14 108/65
6,082,026 A 7/2000 Sand et al.
6,089,592 A 7/2000 Negus
6,105,992 A 8/2000 Schaller et al.
6,116,634 A 9/2000 Mometti
6,126,625 A 10/2000 Lundberg
6,138,384 A 10/2000 Messmer
6,206,402 B1 3/2001 Tanaka
6,231,057 B1 5/2001 Reuss et al.
6,272,772 B1 8/2001 Sherman
6,276,708 B1 8/2001 Hogstedt
6,390,492 B1 5/2002 Bumgarner et al.
6,464,237 B1 10/2002 Gracie
6,505,841 B1 1/2003 Kessler et al.
6,523,851 B1 2/2003 Maravetz
6,554,295 B2 4/2003 Rittmeyer
6,578,865 B1 6/2003 Chaput
6,609,720 B2 8/2003 Marmonier
6,616,151 B1 9/2003 Golling
6,648,365 B1 11/2003 Laughlin et al.
6,705,633 B2 3/2004 Poscich
6,729,642 B2 5/2004 Gouzes et al.
6,733,030 B2 5/2004 Okajima et al.
6,786,502 B2 9/2004 Carlson
6,792,702 B2 9/2004 Borsoi et al.
6,863,285 B2 3/2005 Gonthier
6,969,075 B2 11/2005 Dean et al.
7,029,023 B2 4/2006 Fourgere
7,073,813 B2 7/2006 Martin et al.
7,097,194 B2 8/2006 Kogler
7,147,233 B2 12/2006 Edmond
7,204,495 B2 4/2007 Reuss et al.
7,207,592 B2 4/2007 Pascal et al.
7,232,147 B2 6/2007 Courderc
7,246,811 B2 7/2007 Martin et al.
7,267,357 B2 9/2007 Miller et al.
7,306,241 B2 12/2007 Cunningham et al.
7,320,474 B2 1/2008 Quellais et al.
7,367,579 B2 5/2008 Elkington
7,427,079 B2 9/2008 Piva
7,503,579 B2 3/2009 Courderc
7,516,976 B2 4/2009 Cunningham et al.
7,568,719 B2 8/2009 Sauter
7,621,542 B2 11/2009 Warburton et al.
7,628,419 B2 12/2009 Gogarty
7,669,880 B2 3/2010 Doyle et al.
7,681,904 B2 3/2010 Ekberg
7,694,994 B2 4/2010 Lang et al.
7,823,905 B2 11/2010 Ritter
7,832,754 B2 11/2010 Girard et al.
7,931,292 B2 4/2011 Miralles
7,992,888 B2 8/2011 Steere
8,033,564 B2 10/2011 Riepler et al.
8,132,818 B2 3/2012 Cunningham et al.
8,167,321 B2 5/2012 Cunningham et al.
8,226,109 B2 7/2012 Ritter
8,348,299 B2 1/2013 Ekberg
8,371,605 B2 2/2013 Neiley et al.
8,469,372 B2 6/2013 Kloster et al.
8,480,546 B2 7/2013 Spencer
8,662,505 B2 3/2014 Cunningham et al.
8,684,394 B2 4/2014 Smith
8,708,371 B2 4/2014 Balun
8,720,910 B2 5/2014 Caslowitz
8,733,783 B2 5/2014 Kloster et al.
8,764,043 B2 7/2014 Neubauer et al.
8,857,845 B2 10/2014 Ohlheiser
9,132,336 B2 9/2015 Bulan
9,138,628 B2 9/2015 Kloster et al.

(56) References Cited

U.S. PATENT DOCUMENTS

| | | | | |
|---|---|---|---|---|
| 9,220,968 | B2 | 12/2015 | Ritter | |
| 9,227,131 | B2 | 1/2016 | Adamczewski et al. | |
| 9,238,168 | B2 | 1/2016 | Kloster et al. | |
| 9,266,010 | B2 | 2/2016 | Kloster et al. | |
| 9,452,344 | B2 | 9/2016 | Ritter | |
| 9,604,122 | B2 * | 3/2017 | Kloster | A63C 5/031 |
| 9,795,861 | B1 | 10/2017 | Kloster et al. | |
| 9,821,214 | B2 | 11/2017 | Browning | |
| 9,937,407 | B2 | 4/2018 | Kloster et al. | |
| 10,029,165 | B2 | 7/2018 | Kloster et al. | |
| 10,112,103 | B2 | 10/2018 | Kloster et al. | |
| 10,279,239 | B2 | 5/2019 | Kloster et al. | |
| 10,343,049 | B2 | 7/2019 | Kloster et al. | |
| 10,898,785 | B2 | 1/2021 | Kloster et al. | |
| 11,117,042 | B2 | 9/2021 | Kloster et al. | |
| 11,266,898 | B2 * | 3/2022 | Rosiak | A63C 5/02 |
| 2002/0062581 | A1 | 5/2002 | Courderc | |
| 2003/0075885 | A1 | 4/2003 | Laughlin | |
| 2004/0061311 | A1 | 4/2004 | De Bortoli et al. | |
| 2004/0169343 | A1 | 9/2004 | Fougere | |
| 2005/0057009 | A1 | 3/2005 | Courderc | |
| 2005/0161911 | A1 | 7/2005 | Piva | |
| 2005/0177083 | A1 | 8/2005 | Heil | |
| 2005/0253347 | A1 | 11/2005 | Martin et al. | |
| 2006/0175802 | A1 | 8/2006 | Maravetz et al. | |
| 2006/0237920 | A1 | 10/2006 | Steere | |
| 2007/0063459 | A1 | 3/2007 | Kavarsky | |
| 2007/0170697 | A1 | 7/2007 | Courderc | |
| 2007/0216137 | A1 | 9/2007 | Ritter | |
| 2008/0116664 | A1 | 5/2008 | Warburton | |
| 2008/0185814 | A1 | 8/2008 | Riepler et al. | |
| 2009/0146396 | A1 | 6/2009 | Hahnenberger | |
| 2009/0146397 | A1 | 6/2009 | Steere | |
| 2009/0250906 | A1 | 10/2009 | Ritter | |
| 2010/0304937 | A1 | 12/2010 | Spencer | |
| 2011/0184326 | A1 | 7/2011 | Ingimundarson et al. | |
| 2011/0197362 | A1 | 8/2011 | Chella et al. | |
| 2011/0254251 | A1 | 10/2011 | Jung | |
| 2011/0285109 | A1 | 11/2011 | Horn | |
| 2012/0061927 | A1 | 3/2012 | Krenn | |
| 2012/0256395 | A1 | 10/2012 | Ritter | |
| 2012/0274036 | A1 * | 11/2012 | Kloster | A63C 9/006 280/11.31 |
| 2012/0292887 | A1 | 11/2012 | Ohlheiser | |
| 2013/0147159 | A1 | 6/2013 | Neiley et al. | |
| 2013/0193672 | A1 | 8/2013 | Bulan | |
| 2013/0341889 | A1 | 12/2013 | Neubauer | |
| 2014/0210187 | A1 | 7/2014 | Ritter | |
| 2014/0232087 | A1 | 8/2014 | Bulan | |
| 2015/0014962 | A1 | 1/2015 | Rayner | |
| 2015/0021881 | A1 | 1/2015 | Hutchison | |
| 2015/0048597 | A1 | 2/2015 | Tudor | |
| 2015/0157920 | A1 | 6/2015 | Adamczewski et al. | |
| 2015/0343297 | A1 | 12/2015 | Ekberg | |
| 2016/0136505 | A1 | 5/2016 | Kavarsky | |
| 2016/0175691 | A1 | 6/2016 | Ritter | |
| 2016/0199722 | A1 | 7/2016 | Ritter | |
| 2016/0279505 | A2 | 9/2016 | Ritter | |
| 2017/0050105 | A1 | 2/2017 | Browning | |
| 2017/0189788 | A1 | 7/2017 | Wariakois | |
| 2017/0216710 | A1 | 8/2017 | Debney | |
| 2018/0200606 | A1 * | 7/2018 | Ritter | A63C 5/031 |
| 2022/0266119 | A1 | 8/2022 | Kloster et al. | |

FOREIGN PATENT DOCUMENTS

| | | | | |
|---|---|---|---|---|
| DE | 89 03154.7 | | 3/1989 | |
| DE | 91 08 618.3 | | 1/1992 | |
| DE | 296 18 514 | U1 | 10/1996 | |
| EP | 47059 | A * | 3/1982 | |
| EP | 0 362 782 | A2 | 4/1990 | |
| EP | 0 680 775 | B1 | 11/1995 | |
| FR | 2850031 | A1 * | 7/2004 | A43B 5/0496 |
| GB | 2190128 | A * | 11/1987 | E05C 19/14 |
| WO | WO 1998/017355 | | 4/1998 | |
| WO | WO-2014007658 | A1 * | 1/2014 | A63C 5/031 |

OTHER PUBLICATIONS

EP-47059-A English Translation (Year: 1982).*
GB-2190128-A English Translation (Year: 1987).*
FR-2850031-A1 English Translation (Year: 2004).*
WO-2014007658-A1 English Translation (Year: 2014).*
Brochure for Nitro USA Snowboards, dated 1993-1994.
Web page showing Salomon SNS Pilot Combi binding, www.salomon.com/us/products/sns-pilot-combi.html, dated Mar. 20, 2012.
U.S. Appl. No. 13/458,560, filed Apr. 27, 2012, including its prosecution history.
U.S. Appl. No. 15/942,142, filed Mar. 30, 2018, including its prosecution history.
Purported excerpts of Nitro USA Snowboards Catalog, 1993-1994.
Purported brochure of Nitro USA Snowboards and Fritschi Tour Snowboard Binding.
Purported photographs of Nitro Board and Tour Lock System.

* cited by examiner

SPLITBOARD JOINING DEVICE

INCORPORATION BY REFERENCE TO ANY PRIORITY APPLICATIONS

The present application claims priority benefit under 35 U.S.C. § 120 to and is a continuation of U.S. patent application Ser. No. 17/675,412, filed Feb. 18, 2022, titled "SPLITBOARD JOINING DEVICE," which claims priority benefit under 35 U.S.C. § 119 from U.S. Provisional Application No. 63/152,153, filed Feb. 22, 2021, titled "SPLITBOARD JOINING DEVICE." The entirety of each of the above-identified applications is hereby incorporated by reference herein and made a part of the present disclosure.

BACKGROUND

The present disclosure generally relates to split snowboards, also known as splitboards, and includes the disclosure of embodiments of splitboard joining devices. Splitboards are used for accessing backcountry terrain. Splitboards have a "ride mode" and a "tour mode." In ride mode, the splitboard is configured with at least two skis held together to form a board similar to a snowboard, with bindings mounted somewhat perpendicular to the edges of the splitboard. In ride mode, a user can ride the splitboard down a mountain or other decline, similar to a snowboard. In tour mode, the at least two skis of the splitboard are separated and configured with bindings that are typically mounted like a cross country free heel ski binding. In tour mode, a user normally attaches skins to create traction when climbing up a hill. In some instances, additional traction beyond what the skins provide is desirable and, for example, crampons are used. When a user reaches the top of the hill or desired location, the user can change the splitboard from tour mode to ride mode and snowboard down the hill.

SUMMARY

Some embodiments provide a splitboard joining device having a first attachment and a second attachment. The first attachment and the second attachment can attach to a first ski and a second ski, respectively, of a splitboard. The first and second attachments can comprise a first configuration where the first and second attachments are joined, thus creating tension between the first attachment and second attachment and compression between the first ski and second ski. The splitboard joining device can also have a first tension element configured to move in a plane generally parallel to a top surface of the first and second ski to engage the first attachment and second attachment in the first configuration.

In some embodiments, the first and second attachments also can comprise a second configuration where the first and second attachments are disengaged, thus reducing tension between the first attachment and second attachment and compression between the first and second ski to allow the skis to be separated.

In some embodiments, the first attachment can comprise a first element to prevent upward movement of the second ski relative to the first ski. Similarly, the second attachment can comprise a second element to prevent upward movement of the first ski relative to the second ski.

In some embodiments, when the first and second attachments are joined in the first configuration, the attachments can clamp together in at least two directions such that a first clamping direction is generally perpendicular to a seam of the splitboard.

In some embodiments, the second attachment can comprise at least one slotted hole to control the tightness of fit between the first attachment and the second attachment in the first configuration. The second attachment can also comprise a threaded hole generally perpendicular to the seam of the splitboard and generally parallel with the top surface of the splitboard. The second attachment can be made of one or more parts that move in unison relative to a mounting fastener attached to the second ski. The tightness of fit between the first attachment and the second attachment can be determined by a set screw threaded into the threaded hole of the second attachment contacting the mounting fastener attached to the second ski. In some embodiments, turning the set screw in one direction tightens the fit between the first attachment and second attachment and turning the set screw in the opposite direction loosens the fit between the first attachment and second attachment.

In some embodiments, either the first attachment or the second attachment comprises a first tension element. The first tension element can be moveable in a plane generally parallel to a top surface of the first ski and second ski to engage the first attachment and the second attachment in the first configuration. The first tension element can be configured to be driven by a lever and a linkage. The lever can rotate about a pivot. A first fastener can constrain the pivot in a direction generally normal to the top surface of the first or second ski. The first fastener can attach the first or second attachment to the first or second ski.

BRIEF DESCRIPTION OF THE DRAWINGS

Features, aspects, and advantages of the disclosed apparatus, systems, and methods will now be described in connection with embodiments shown in the accompanying drawings, which are schematic and not necessarily to scale. The illustrated embodiments are merely examples and are not intended to limit the apparatus, systems, and methods. The drawings include the following figures, which can be briefly described as follows.

DESCRIPTION

Figure 1:
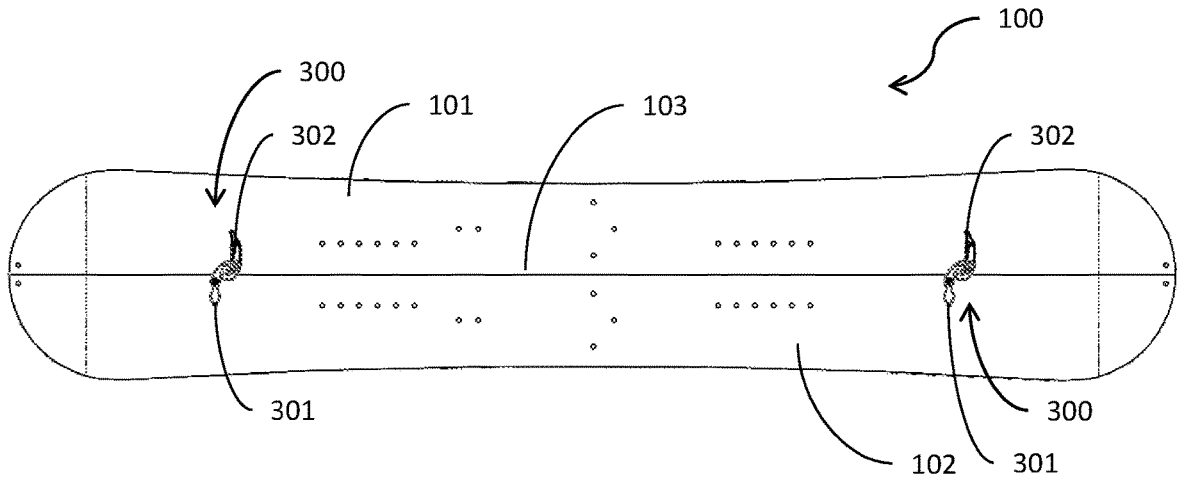
FIG. 1 is a top view of a splitboard in the snowboard configuration.

A splitboard is a snowboard that splits into at least two skis for climbing uphill in a touring configuration. When the splitboard is in the touring configuration, traction skins can be applied to the base of the snowboard to provide traction when climbing uphill. The user can use the skis like cross country skis to climb. When the user reaches a location where the user would like to snowboard down a hill, the user removes the traction skins and joins the at least two skis with a joining device to create a snowboard. An integral part of achieving optimal performance, such that the splitboard performs like a solid snowboard, is the joining device's ability to prevent the at least two skis from moving relative to each other.

Where the skis touch to create a snowboard is referred to as the "seam." If a splitboard has relative movement between the at least two skis, torsional stiffness is lost, flex in the splitboard is compromised, and ultimately performance is reduced which leads to lack of control for the user. For a splitboard to perform like a solid snowboard, the joining device should allow the at least two skis to act as one snowboard with, for example, torsional stiffness and tip-to-tail flex. The joining device also should prevent the splitboard skis from shearing or moving up and down relative to each other, moving apart in a direction perpendicular to the seam, sliding relative to each other in a direction parallel to the seam, and rotating about the seam. Existing devices only provide clamping in a direction perpendicular to the seam of the splitboard, thus relying on simple contact surfaces to constrain the splitboard skis in directions parallel to the seam and normal to the top surfaces of the splitboard skis.

To better constrain movement in the skis relative to each other in directions perpendicular and parallel to the seam and normal to the top surface of the splitboard skis, the joining device should create tension in itself in a direction perpendicular and parallel to the seam and thus compression at the seam of the splitboard between the at least two skis and create compression between the joining device and the top surface of each splitboard skis. For this tension and compression to be obtained and still be able to easily separate the at least two skis, the joining device should have the ability to increase and decrease tension easily.

Existing devices can create tension in the joining device and compression at the seam of the splitboard between the at least two skis, but lack the ability to fully constrain rotation about the seam of the splitboard. Fully constraining rotation about the seam of the splitboard is an important element to making a splitboard ride like a normal snowboard. If the splitboard can rotate about the seam, the rider's input into the splitboard is delayed, which creates a less responsive ride down the mountain. There are existing devices that can limit rotation in the seam, but they lack the ability to create tension in the joining device and compression in the seam of the splitboard. These devices rely heavily on the precision of installation to prevent rotation about the seam of the splitboard. If the device is installed loosely, or when the device wears down with use, rotation about the seam of the splitboard can occur, the skis can move perpendicularly to the seam of the splitboard, and the skis can move parallel to the seam of the splitboard, thus creating a less responsive ride down the mountain. There is a need for a splitboard joining device that can quickly and easily join the skis of a splitboard to create a snowboard while clamping the splitboard skis in a direction perpendicular and parallel to the seam of the splitboard and normal to the top surface of the splitboard skis, thereby preventing the splitboard skis from shearing or moving up and down relative to each other, moving apart in a direction perpendicular to the seam, sliding relative to each other in a direction parallel to the seam, and rotating about the seam.

Figure 2:
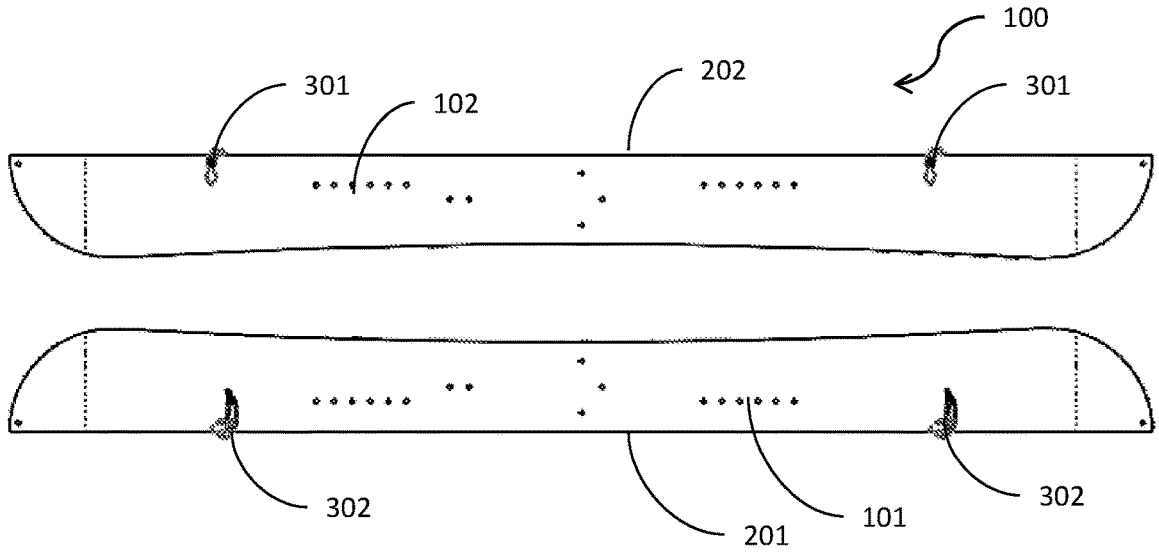
FIG. 2 is a top view of a splitboard in the split ski configuration.

With reference to the drawings, FIGS. 1 and 2 show a splitboard 100. FIG. 1 illustrates a top view of the splitboard 100 with a first ski 101 and a second ski 102 joined in the snowboard configuration. Joined splitboard 100 has a seam 103 created by inside edge 201 (see FIG. 2) of first ski 101 and inside edge 202 (see FIG. 2) of second ski 102 touching. An important element in creating a splitboard that performs well in ride mode is creating continuity between first ski 101 and second ski 102. Compressing inside edges 201 and 202 together at the seam 103 creates torsional stiffness in splitboard 100. Splitboard 100 is joined by splitboard joining device 300, which comprises a first attachment 302 and a second attachment 301. FIG. 1 shows the splitboard 100 joined by two joining devices 300. However, the splitboard can be joined by any number of joining devices, such as one, two, three, four, or more joining devices.

FIG. 2 illustrates a top view of the splitboard 100 with a first ski 101 and a second ski 102 in the split ski configuration. In the split ski configuration, the user can apply traction devices to the skis 101 and 102 to climb up snowy hills. In this embodiment, first attachment 302 disengages from second attachment 301 of each joining device 300, allowing the skis 101 and 102 to be separated.

Figure 3A:
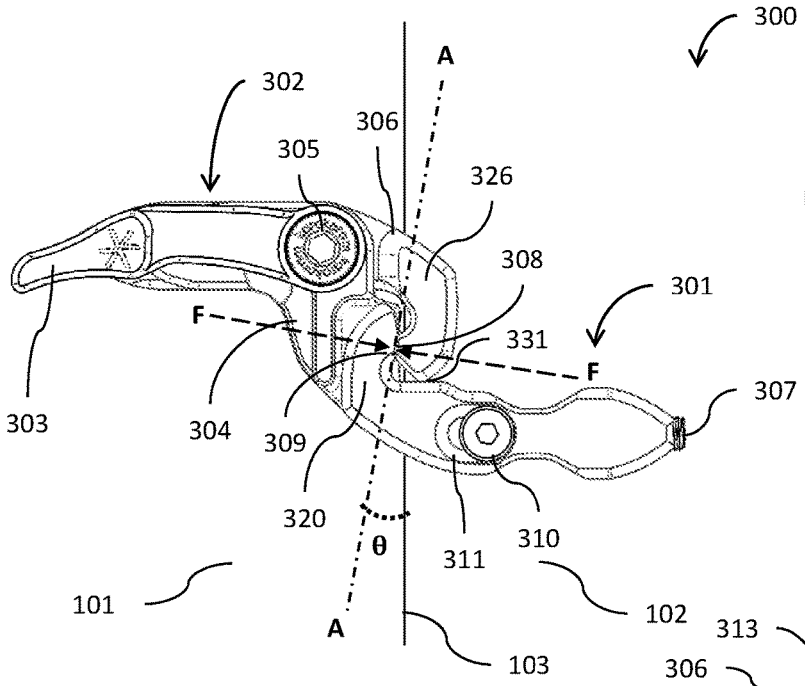
FIG. 3A is a top view of an example splitboard joining device in a clamped configuration.
Figure 3B:
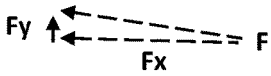
FIG. 3B is a top view of clamping force F and component forces Fx and Fy.

FIGS. 3A-3F show detailed views of embodiments of the splitboard joining device 300. FIG. 3A shows a top view of splitboard joining device 300, which can comprise a first attachment 302 and a second attachment 301. FIG. 3A further shows a top view of splitboard joining device 300 in a first configuration where the first attachment 302 and the second attachment 301 are joined, creating tension between the first attachment 302 and the second attachment 301 and compression between the first ski 101 and the second ski 102. FIG. 3B shows the clamping force F between first attachment 302 and second attachment 301, which comprises a horizontal component force Fx and a vertical component force Fy. Fx is generally perpendicular to the seam 103. Fy is generally parallel to the seam 103.

Figure 3D:
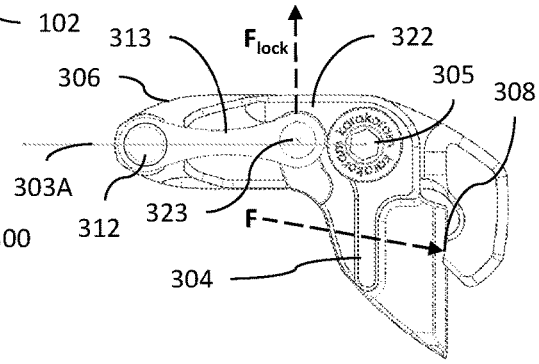
FIG. 3D is a top view of example splitboard joining device with a lever removed.
Figure 3C:
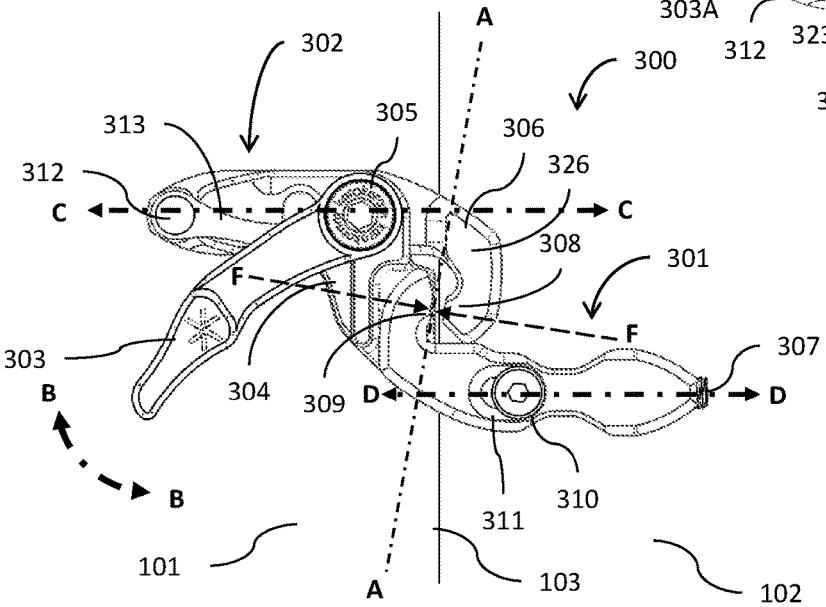
FIG. 3C is a top view of an example splitboard joining device in an unclamped configuration
Figure 3E:
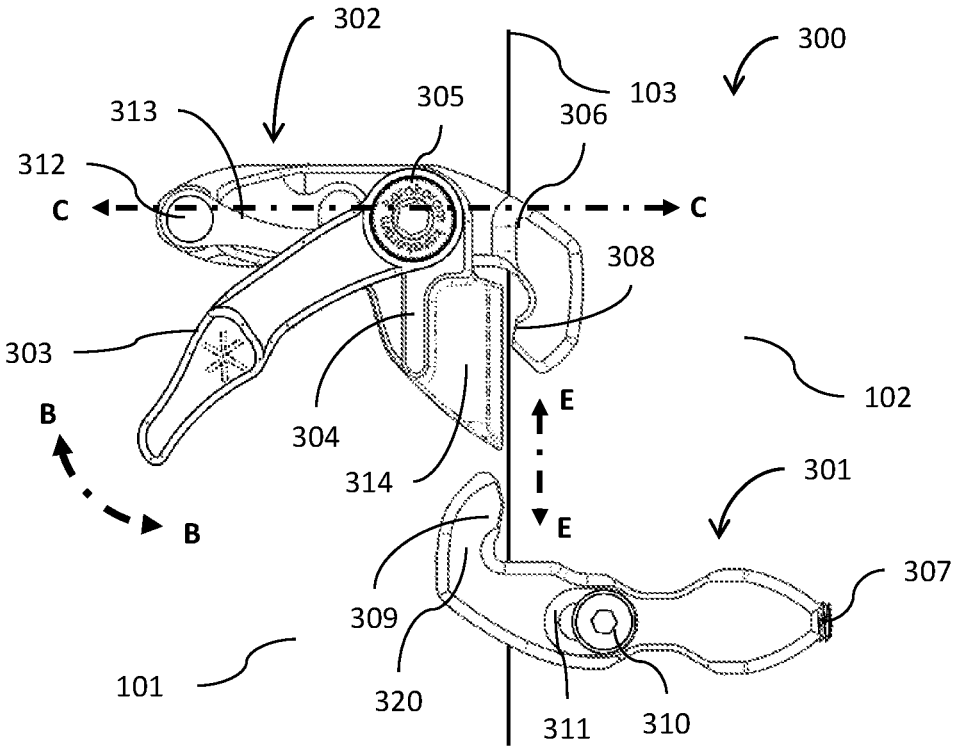
FIG. 3E is a top view of an example splitboard joining device separating in a direction parallel to the seam of a splitboard.
Figure 3F:
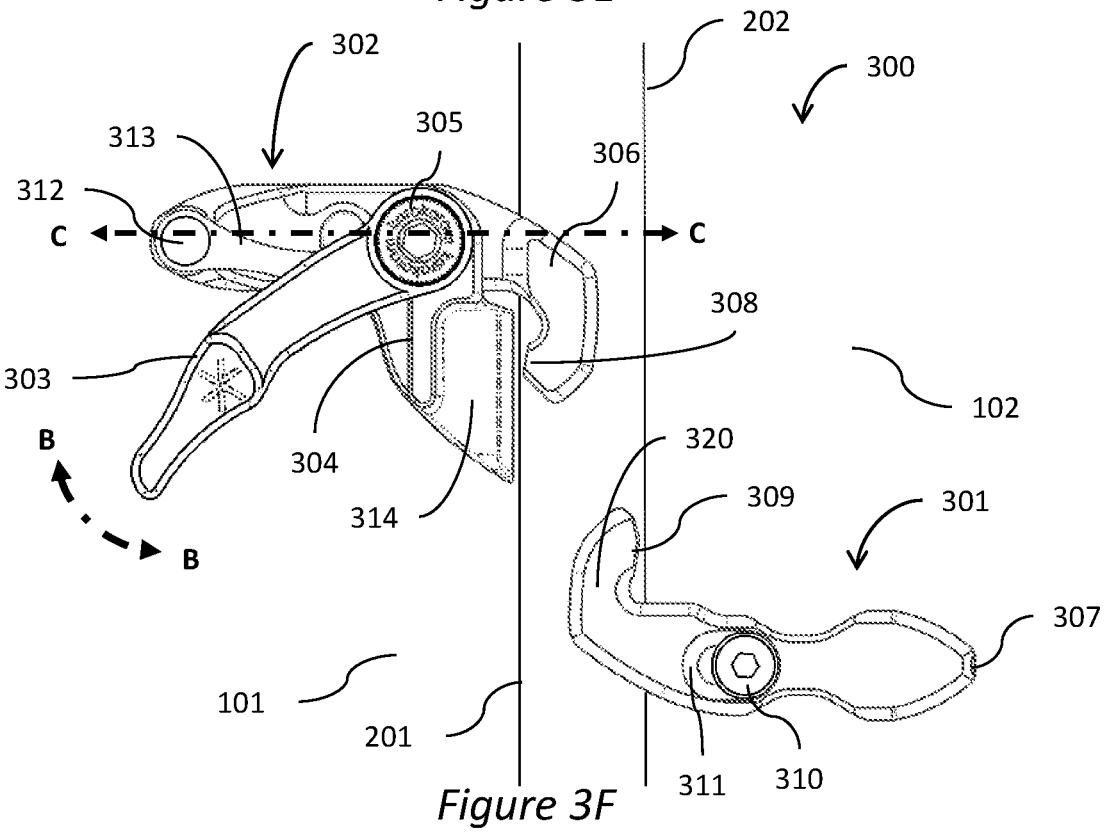
FIG. 3F is a top view of an example splitboard joining device separating in a direction perpendicular to the seam of a splitboard.

FIG. 3C shows a top view of the splitboard joining device 300 in a second configuration where the first attachment 302 and the second attachment 301 are disengaged in a direction generally perpendicular to the seam 103 of splitboard 100, allowing the first ski 101 and second ski 102 to be quickly and easily separated into the split ski configuration shown in FIG. 2. FIG. 3D shows a top view of the first attachment 302 with the lever 303 removed to show the over-center locking feature. FIG. 3E shows a top view of the first attachment 302 and second attachment 301 shifted parallel to seam 103 along path E-E. FIG. 3F shows a top view of the first ski 101 and second ski 102 moving apart perpendicular to the seam 103 along path C-C.

First attachment 302 can further comprise a translational base portion 306, fixed base portion 304, drive link 313, lever 303 and main pivot 305. Translational base portion 306 can further comprise angled clamping surface 308 and contact surface 331. Lever 303 can be attached to translational base portion 306 with drive link 313. Translational base portion 306 can further comprise a shear tab 326 to prevent upward movement of second ski 102 relative to first ski 101. In some embodiments, shear tab 326 can extend over seam 103. In other embodiments, shear tab 326 can prevent upward movement of second ski 102 relative to first ski 101 without extending past seam 103. Translational base portion 306 can move generally along path C-C when lever 303 is rotated about path B-B on main pivot 305 and drive link 313 pushes or pulls translational base portion 306. Drive link 313 can be oriented to move in a plane generally parallel to the top surface of first ski 101 and second ski 102.

Second attachment 301 can further comprise a receiving element 320 that can connect to first attachment 302, with angled clamping surface 309. Second attachment 301 can further comprise a shear tab 317 (see FIG. 4B) to prevent upward movement of first ski 101 relative to second ski 102. Second attachment 301 can further comprise second tension element 307, which can be a set screw and slotted mounting hole 311 for adjusting the position of second attachment 301 relative first attachment 302 along path D-D to increase or decrease the tension between first attachment 302 and second attachment 301 in the first configuration where first attachment 302 and second attachment 301 are joined. Second attachment 301 can be attached to second ski 102 with fastener 310, which can be a screw, bolt, rivet or any mechanical fastening device. Main pivot 305 can be a screw which attaches first attachment 302 to first ski 101.

When lever 303 is rotated counter-clockwise about path B-B on main pivot 305, translational base portion 306 can be pulled along path C-C by drive link 313 reducing tension in splitboard joining device 300. When lever 303 is rotated fully counter-clockwise, the splitboard joining device 300 is in the unclamped position with first attachment 302 and second attachment 301 disengaged, as shown in FIG. 3C. When lever 303 is rotated clockwise about path B-B on main pivot 305, translational base portion 306 can be pushed along path C-C by drive link 313 increasing tension in splitboard joining device 300. When lever 303 is rotated fully clockwise, the splitboard joining device 300 is in the clamped position shown in FIG. 3A. In FIG. 3C, FIG. 3E and FIG. 3F, the rotational directions shown are examples and other arrangements are within the scope of the inventions. For example, in other embodiments, the direction of rotation can be switched (e.g., lever 303 can be configured to rotate clockwise to unclamp and counter-clockwise to clamp the splitboard joining device 300).

When splitboard joining device 300 is joined in the clamped first configuration shown in FIG. 3A, clamping surface 308 of translational base portion 306 of first attachment 302 and clamping surface 309 of receiving element 320 of second attachment 301 are clamped together creating clamping force F. Clamping surface 309 and clamping surface 308 are generally parallel surfaces, and parallel to line A-A which is positioned at an angle θ relative to seam 103. Clamping force F is perpendicular to line A-A. Clamping force F is broken into component forces Fx and Fy, as shown in FIG. 3B. The clamping force component $Fy=F*\sin\theta$ and acts in a direction parallel to seam 103. The clamping force component $Fx=F*\cos\theta$ and acts in a direction perpendicular to the seam 103. Clamping force Fx creates tension between first attachment 302 and second attachment 301 in a direction perpendicular to the seam 103, thus creating compression between first ski 101 and second ski 102 at seam 103. Clamping force Fy creates compression between clamping surface 308 and clamping surface 309, preventing first ski 101 and second ski 102 from moving in a direction generally parallel to the seam 103. In addition to clamping force Fy, contact surface 331 of first attachment 302 can contact second attachment 301 to prevent first attachment 302 from moving closer to second attachment 301 in a direction parallel to seam 103.

FIG. 3D shows a top view of first attachment 302 with lever 303 removed and replaced with line 303A for ease of viewing the over-center locking of first attachment 302. Line 303A is connected between main pivot 305 and drive link connection 312. Link lever attachment 323 sits above line 303A. When force F is applied to clamping surface 308 of translational base portion 306, translational base portion 306 pushes on drive link 313 through drive link connection 312. Because link lever attachment 323 is above line 303A, when translational base portion 306 pushes on drive link 313 link lever attachment 323 wants to move in the direction of force $F_{lock}$ which prevents lever 303 from opening. Drive link 313 presses up against stop 322 of fixed base portion 304 when clamping force F is applied to clamping surface 308.

In other embodiments, translational base portion 306 can be replaced with an eccentric lobe or lobes rotating about main pivot 305 to create tension between first attachment 302 and second attachment 301. The eccentric lobes can be used to increase and decrease tension between first attachment 302 and second attachment 301. Translational base portion 306 can be replaced by any mechanical element that can increase and decrease tension between first attachment 302 and second attachment 301.

Figure 4A:
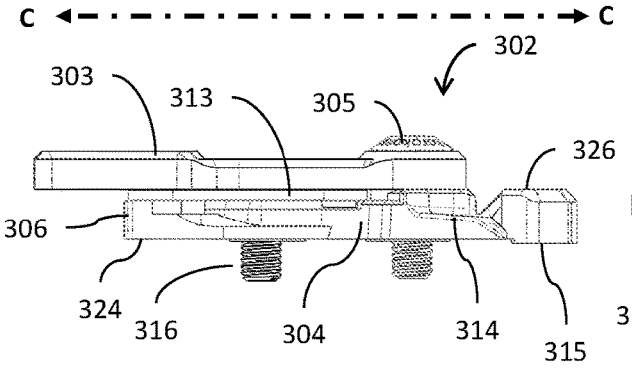
FIG. 4A is a side view of an example splitboard joining device tension element.

FIG. 4A-4D show side views of splitboard joining device 300. FIG. 4A shows a side view of first attachment 302, further showing main pivot 305 as a screw which can extend through first attachment 302 and connect to a first ski 101 (not shown in FIG. 4A). First attachment 302 can be further constrained on first ski 101 by positioning attachment 316 which prevents first attachment 302 from pivoting about main pivot 305. Translational base portion 306 can further comprise first ski contact surface 324 and vertical clamping element 315 which extends below first ski contact surface 324. Vertical clamping element 315 can be part of shear tab 326. First attachment 302 can further comprise ramped clamping surface 314 which can be part of fixed base portion 304.

Figure 4B:
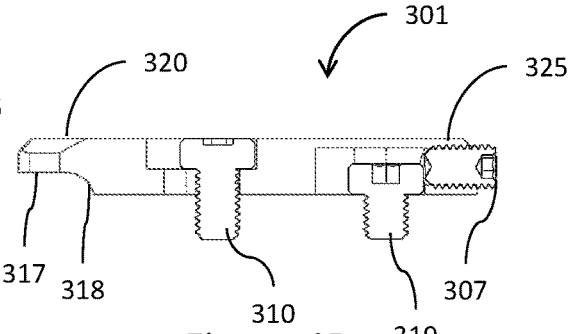
FIG. 4B is a side view of an example splitboard joining device receiving element.

FIG. 4B shows a cross-sectional side view of second attachment 301. Second attachment 301 can further comprise anti-snow surface 318, which can be a radius to prevent a sharp corner that snow can pack into. Second attachment 301 can further comprise a shear tab 317 to prevent upward movement of first ski 101 relative to second ski 102. Second attachment 301 can further comprise a back portion 325. Second tension element 307 can be a set screw, as shown, which contacts mounting fastener 319. Using a set screw as tension element 307 to push off mounting fastener 319 to adjust the position of second attachment 301 relative to the seam 103 is a unique design which simplifies the manufacturing and assembly of the second attachment 301 by reducing the number of parts. When tension element 307 is spun clockwise, back portion 325 of second attachment 301 moves away from the seam 103 which will increase tension in the first configuration and clamped position shown in FIG. 3A. When tension element 307 is spun counterclockwise, back portion 325 of second attachment 301 moves toward the seam 103 which will decrease tension in the first configuration and clamped position shown in FIG. 3A.

Figure 4C:
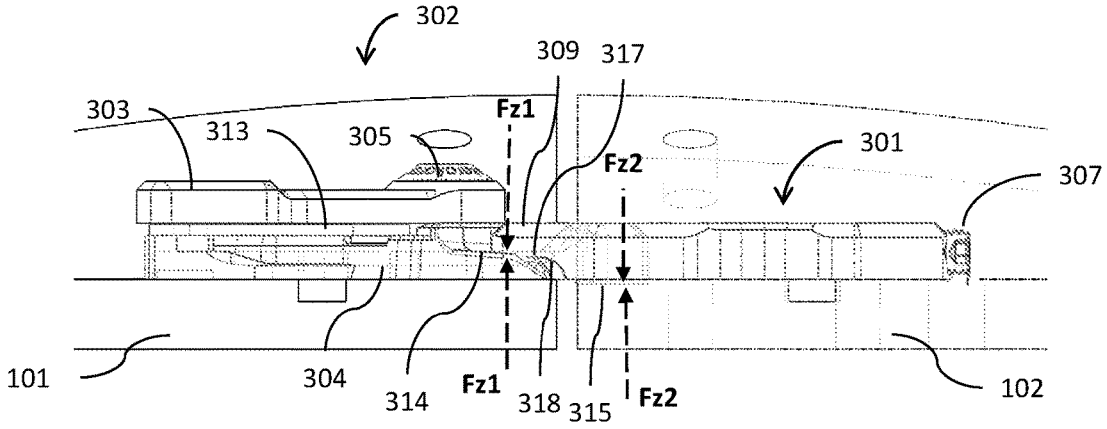
FIG. 4C is a side view of an example splitboard joining device in the unclamped configuration showing clamping in the vertical Fz direction.
Figure 4D:
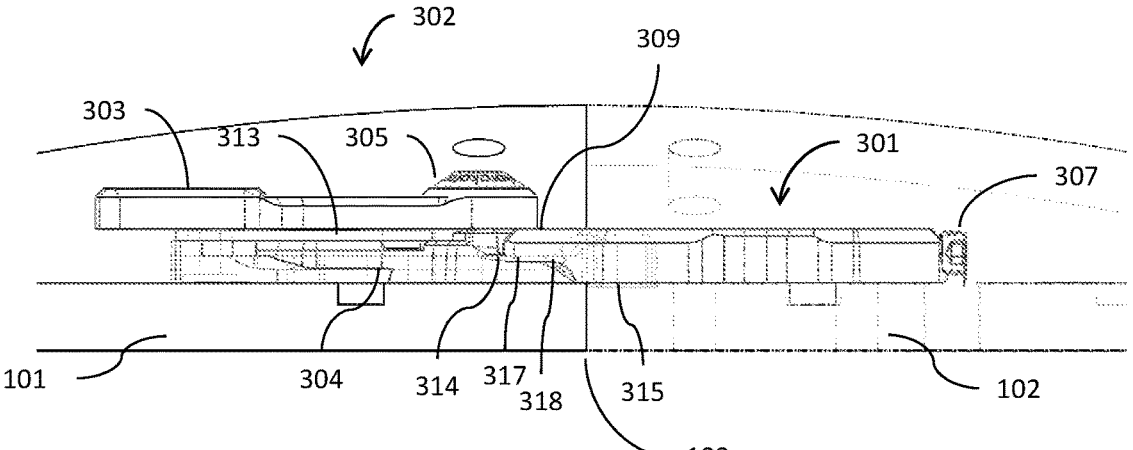
FIG. 4D is a side view of an example splitboard joining device in the clamped configuration showing clamping in the vertical Fz direction.

FIG. 4C shows a side view of splitboard joining device 300 in a second configuration where first attachment 302 and second attachment 301 are unclamped and disengaged in a direction perpendicular to seam 103. FIG. 4C further shows shear tab 317 of second attachment 301 contacting ramped clamping surface 314 of first attachment 302 creating vertical clamping force Fz1. Shear tab 317 pushes into ramped clamping surface 314 of fixed base portion 304 of first attachment 302 which pushes into first ski 101. When ramped clamping surface 314 pushes back on shear tab 317, second attachment 301 pulls up on second ski 102 and second ski 102 presses into vertical clamping element 315 of first attachment 302. Vertical clamping element 315 of shear tab 326 of first attachment 302 can press back into second ski 102, creating vertical clamping force Fz2. When second ski 102 presses into vertical clamping element 315 of first attachment 302, first attachment 302 pulls up on first ski 101. The offset between first ski clamping surface 324 and vertical clamping element 315 is sized to keep the base of first ski 101 and base of second ski 102 coplanar when first attachment 302 and second attachment 301 are in the clamped position and first configuration shown in FIG. 1. As lever 303 is moved to the clamped position as shown in FIG. 4D, first attachment 302 and second attachment 301 are clamped together in directions parallel to seam 103 and perpendicular to seam 103. In addition, shear tab 317 of second attachment 301 slides up ramped clamping surface 314 increasing the clamping forces Fz1 and Fz2. Clamping forces Fz1 and Fz2 create vertical preloading between splitboard joining device 300, first ski 101 and second ski 102 to prevent vertical movement of first ski 101 relative to second ski 102.

Figure 5A:
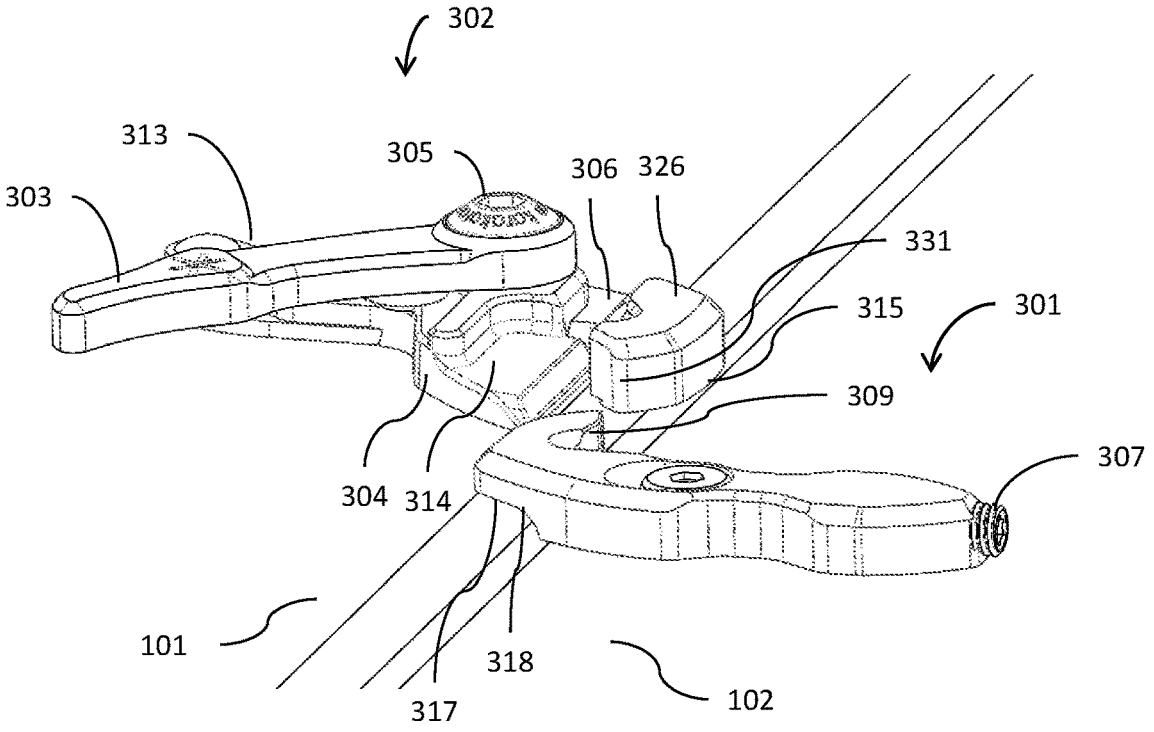
FIG. 5A is an isometric view of an example splitboard joining device.

FIG. 5A is a perspective view of splitboard joining device 300 in a fully disengaged position with first ski 101 and second ski 102 fully separated. First attachment 302 has lever 303 rotated to the open unclamped position.

Figure 5B:
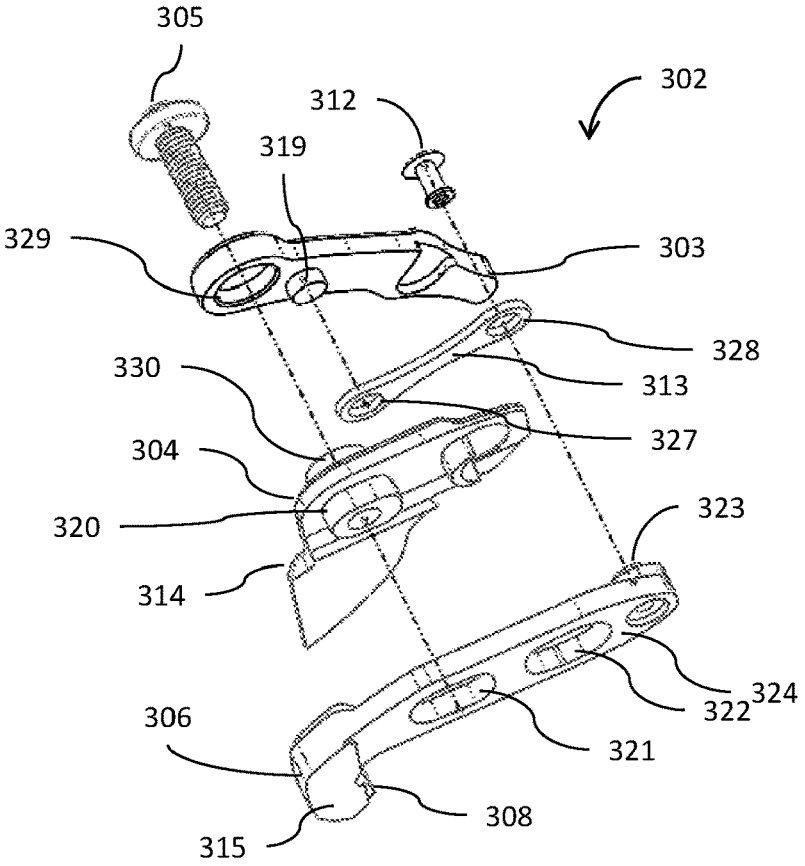
FIG. 5B is an exploded view of an example splitboard joining device.

FIG. 5B is an exploded perspective view of first attachment 302. Lever 303 can attach to drive link 313 at link hole 327 with lever link pivot boss 319. Drive link 313 can attach to translational base portion 306 through link hole 328 and base pivot boss 323. Drive link connection 312 can be a rivet, screw, bolt, pin or any fastener that will prevent drive link 313 from coming off base pivot boss 323. Lever 303 can comprise main pivot hole 329. Main pivot hole 329 can seat over main pivot boss 330 of fixed base portion 304. Fixed base portion 304 can be manufactured by injection molding, die casting, CNC machining, 3D printing, or any other manufacturing means. In a preferred embodiment, the fixed base portion 304 can be an injection molded plastic component such that the main pivot boss 330 is made from a low friction material for lever 303 to pivot on and reduce wear of use. Main pivot 305 can be a screw that threads into main pivot boss 330 of fixed base portion 304 to hold together all of the components of first attachment 302. This unique fastening technique limits the number of fasteners required to hold together first attachment 302, thus reducing manufacturing and assembly costs. Fixed base portion 304 can have guide boss 320 that can fit in slot 321 of translational base portion 306. Guide boss 320 constrains the movement of translational base portion 306 to path C-C shown in FIG. 3C by having a tight fit between the width of guide boss 320 and the width of slot 321. Slot 321 is longer than guide boss 320, allowing translational base portion 306 to move along path C-C. Translational base portion 306 can further comprise rotational constraint slot 322 which interacts with positioning attachment 316 (see FIG. 4A) to prevent rotation of first attachment 302 about main pivot 305. Positioning attachment 316 can be a screw.

Figure 6A:
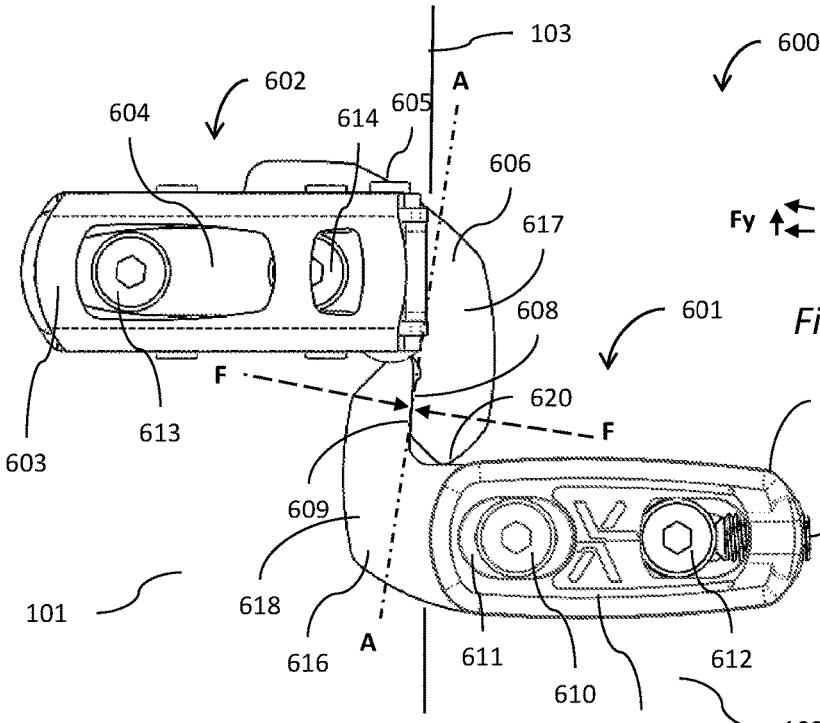
FIG. 6A is a top view of a second example splitboard joining device in a clamped configuration.

FIG. 6A is a top view of a second embodiment splitboard joining device 600 with first attachment 602 and second attachment 601 in a first configuration in a clamped position. Splitboard joining device 600 functions similarly to splitboard joining device 300 by clamping in directions parallel to seam 103 and perpendicular to seam 103. First attachment 602 can comprise lever 603, translational base portion 606, main pivot 605, and fixed base portion 604. First attachment 602 can be attached to first ski 101 with fasteners 613 and 614. Translational base portion 606 can have shear tab 617 to prevent upward movement of second ski 102 relative to first ski 101. Translational base portion 606 can further comprise clamping surface 608. Second attachment 601 can comprise adjustable base portion 615, receiving element 616, and shear tab 618. Shear tab 618 can prevent upward movement of first ski 101 relative to second ski 102. In some embodiments, second attachment 601 can be manufactured from two components: (1) adjustable base portion 615 with complex shapes can be manufactured by injection molding; and (2) receiving element 616 can be a stamped, machined or laser cut metal component that connects to adjustable base portion 615 with puzzle piece features for ease of assembly.

Figure 6B:
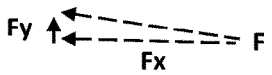
FIG. 6B is a top view of clamping force F and component forces Fx and Fy.

FIG. 6B shows the clamping force F between first attachment 602 and second attachment 601, which comprises a horizontal component force Fx and a vertical component force Fy. Fx is generally perpendicular to the seam 103. Fy is generally parallel to the seam 103.

Figure 6C:
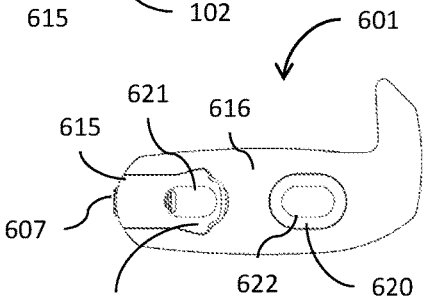
FIG. 6C is a bottom view of a second attachment of a second example splitboard joining device.

FIG. 6C shows a bottom view of second attachment 601 that can have adjustable base portion 615 puzzle piece into receiving element 616. Adjustable base portion 615 can have puzzle piece boss 620 that protrudes into receiving element 616. Adjustable base portion 615 also can have puzzle piece boss 621 that protrudes into receiving element 616. Adjustable base portion 615 can further comprise slots 620 and 621 for tension adjustment. Adjustable base portion 615 can be manufactured by injection molding to reduce the cost of complex features that would be expensive to machine. Second attachment 601 can further comprise second tension element 607, which can be a set screw that threads into adjustable base portion 615 at back portion 619. Second tension element 607 can be a set screw, as shown, which contacts mounting fastener 612. Using a set screw as tension element 607 to push off mounting fastener 612 to adjust the position of second attachment 601 relative to the seam 103 is a unique design which simplifies the manufacturing and assembly the second attachment 601 by reducing the number of parts. When tension element 607 is spun clockwise, back portion 619 of second attachment 601 moves away from the seam 103 which will increase tension in the first configuration and clamped position shown in FIG. 6A. When tension element 607 is spun counterclockwise, back portion 619 of second attachment 601 moves toward the seam 103 which will decrease tension in the first configuration and clamped position shown in FIG. 6A. When splitboard joining device 600 is joined in the clamped first configuration shown in FIG. 6A, clamping surface 608 of translational base portion 606 of first attachment 602 and clamping surface 609 of receiving element 616 of second attachment 601 are clamped together creating clamping force F. Clamping surface 609 and clamping surface 608 are generally parallel surfaces parallel to line A-A, which is positioned at an angle θ relative to seam 103. Clamping force F is perpendicular to line A-A. Clamping force F is broken into component forces, Fx and Fy, shown in FIG. 6B. The clamping force component $Fy=F*\sin\theta$ and acts in a direction parallel to seam 103. The clamping force component $Fx=F*\cos\theta$ and acts in a direction perpendicular to the seam 103. Clamping force Fx creates tension between first attachment 602 and second attachment 601 in a direction perpendicular to the seam 103, thus creating compression between first ski 101 and second ski 102 at seam 103. Clamping force Fy creates compression between clamping surface 608 and clamping surface 609 preventing first ski 101 and second ski 102 from moving in a direction generally parallel to the seam 103. In addition to clamping force, Fy contact surface 620 of first attachment 602 can contact second attachment 601 preventing first attachment 602 from moving closer to second attachment 601 in a direction parallel to seam 103.

Figure 6D:
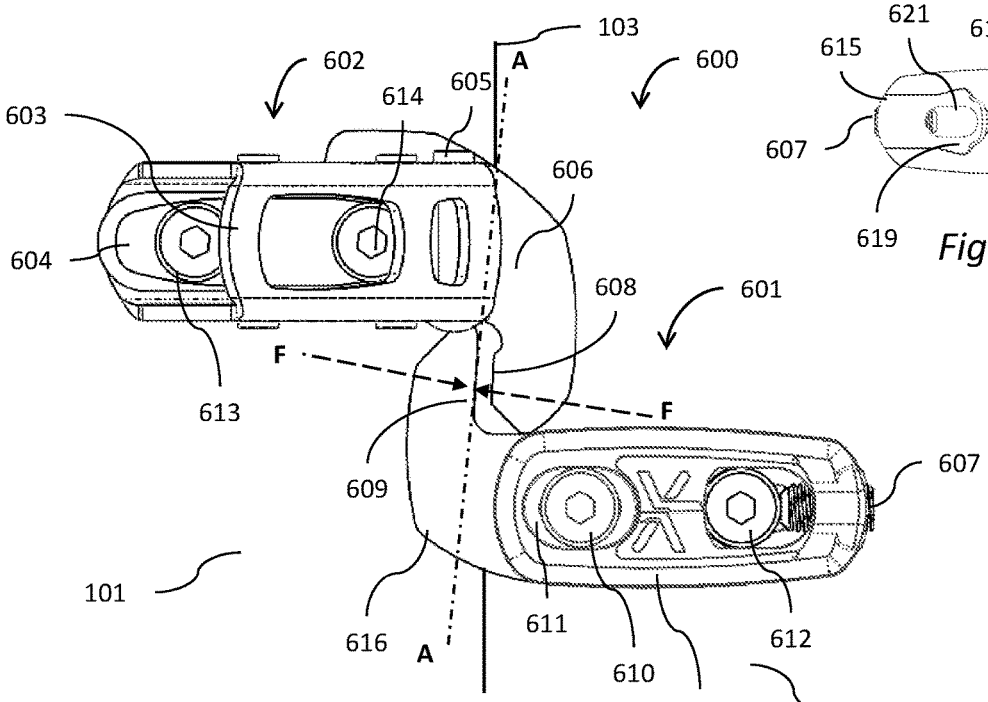
FIG. 6D is a top view of a second example splitboard joining device in an unclamped configuration.

FIG. 6D shows a top view of the splitboard joining device 600 in a second configuration where the first attachment 602 and the second attachment 601 are disengaged in a direction generally perpendicular to the seam 103 of splitboard 100, allowing the first ski 101 and second ski 102 to be quickly and easily separated into the split ski configuration shown in FIG. 2.

Figure 7A:
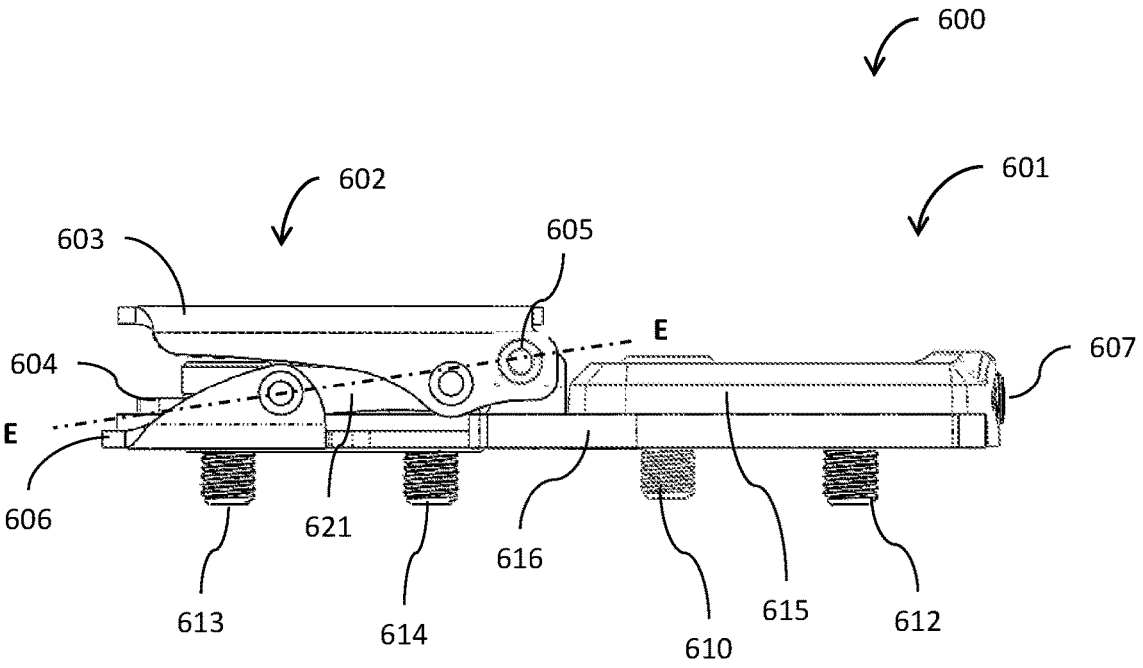
FIG. 7A is a side view of a second example splitboard joining device in a clamped configuration.
Figure 7B:
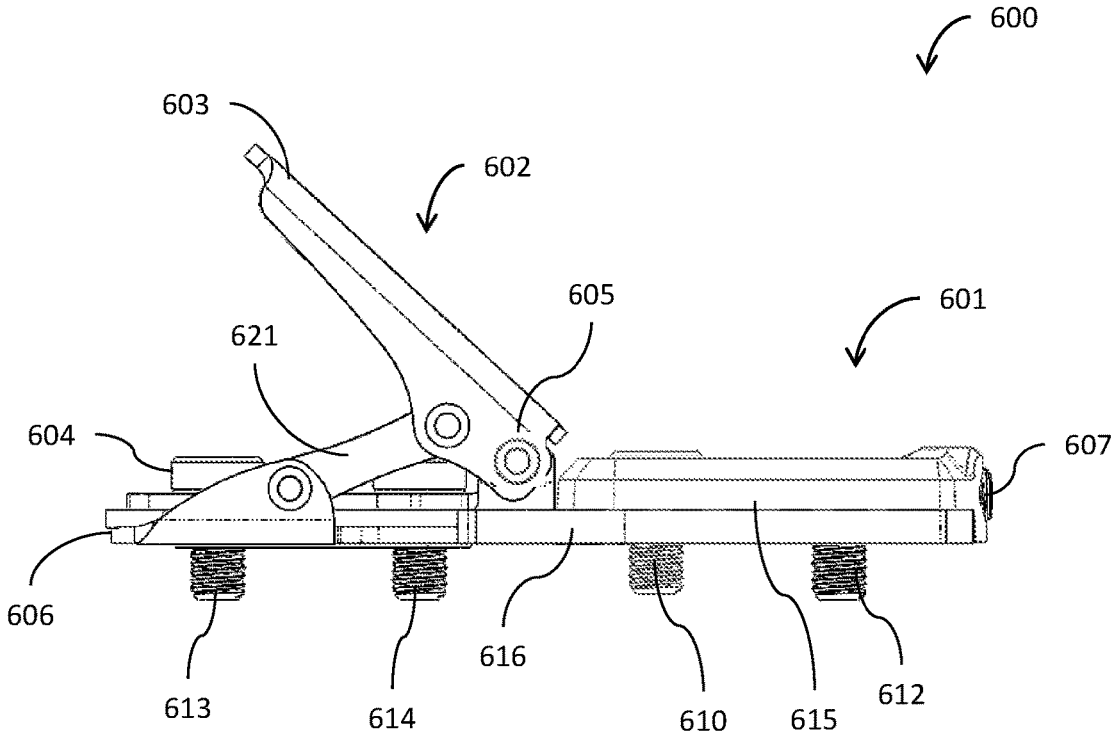
FIG. 7B is a side view of a second example splitboard joining device in an unclamped configuration.

FIG. 7A shows a side view of the splitboard joining device 600 with first attachment 602 and second attachment 601 in a first configuration in a clamped position. FIG. 7B shows a side view of the splitboard joining device 600 in a second configuration where the first attachment 602 and the second attachment 601 are disengaged in a direction generally perpendicular to the seam 103 of splitboard 100 allowing the first ski 101 and second ski 102 to be quickly and easily separated into the split ski configuration shown in FIG. 2. Lever 603 of first attachment 602 lifts in a direction generally normal to the top surface of first ski 101 and second ski 102 and pivots about main pivot 605. Lever 603 drives translational base portion 606 by drive links 621. When lever 603 is lifted as shown in FIG. 7B, translational base portion 606 is moved into the position shown in FIG. 6C.

Figure 8A:
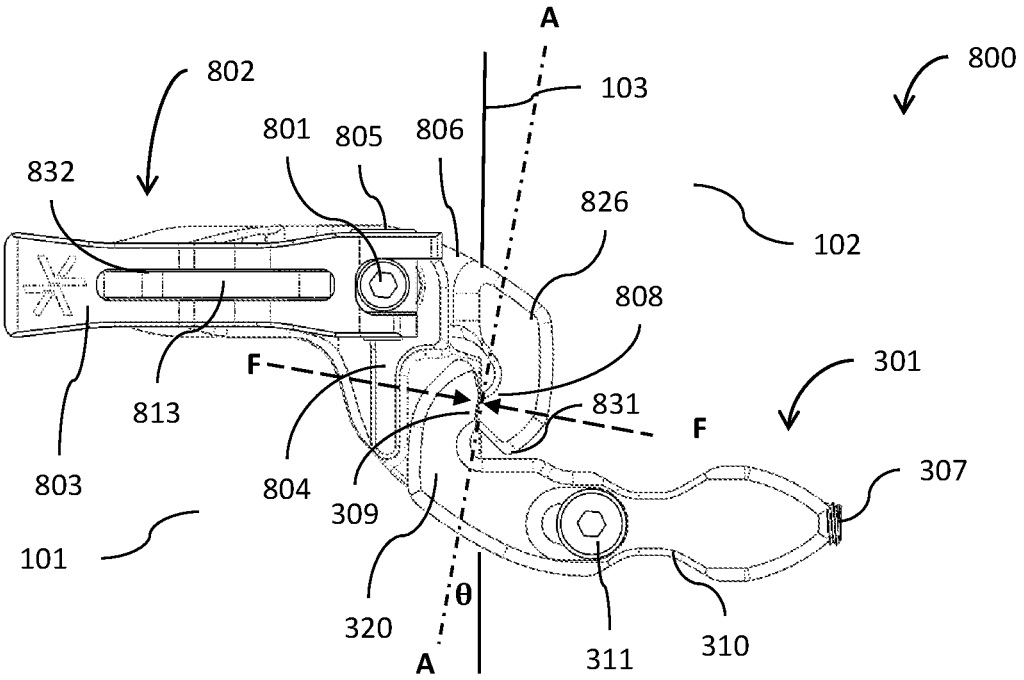
FIG. 8A is a top view of a third example splitboard joining device in a clamped configuration.

FIG. 8A through FIG. 11 show a third embodiment splitboard joining device 800. FIG. 8A shows a top view of splitboard joining device 800 in the clamped position. FIG. 8B shows a top view of splitboard joining device 800 in the unclamped position. Splitboard joining device 800 is similar to splitboard joining device 300. Splitboard joining device 800 can have a first attachment 802 and can have second attachment 301 as shown and described above with respect to FIGS. 3A through 3F. FIG. 8A through FIG. 11 will focus on first attachment 802.

Figure 8C:
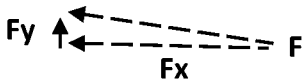
FIG. 8C is a top view of clamping force F and component forces Fx and Fy.
Figure 8B:
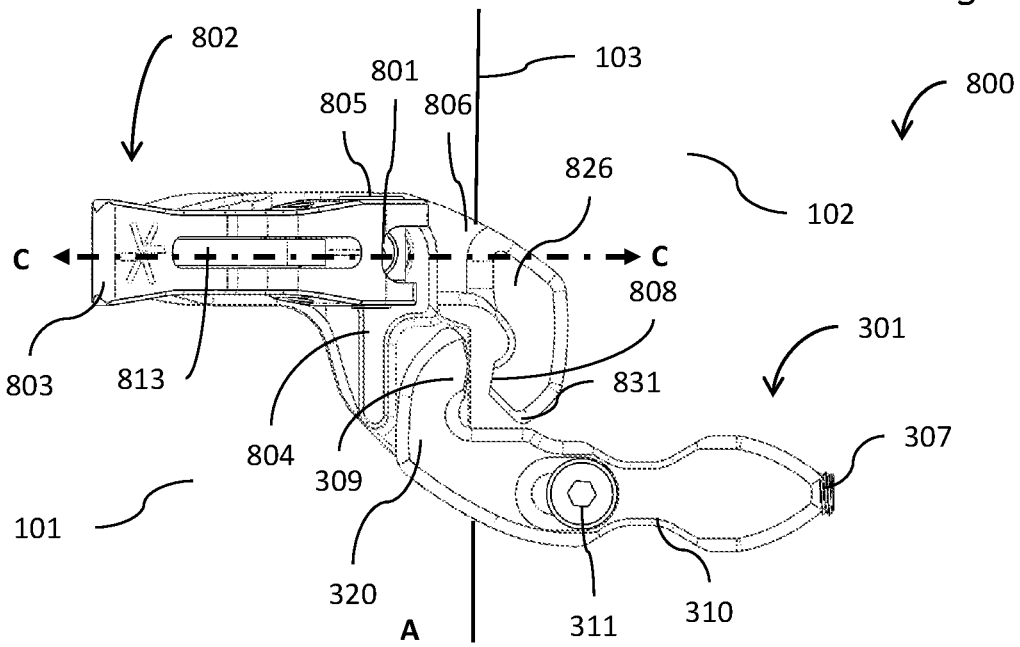
FIG. 8B is a top view of a third example splitboard joining device in an unclamped configuration.

FIG. 8A shows a top view of splitboard joining device 800 in a first configuration where the first attachment 802 and the second attachment 301 are joined, creating tension between the first attachment 802 and the second attachment 301 and compression between the first ski 101 and the second ski 102. FIG. 8C shows the clamping force F between first attachment 802 and second attachment 301, which comprises a horizontal component force Fx and a vertical component force Fy. Fx is generally perpendicular to the seam 103. Fy is generally parallel to the seam 103. FIG. 8B shows a top view of the splitboard joining device 800 in a second configuration where the first attachment 802 and the second attachment 301 are disengaged in a direction generally perpendicular to the seam 103 of splitboard 100, allowing the first ski 101 and second ski 102 to be quickly and easily separated into the split ski configuration shown in FIG. 2.

Figure 9A:
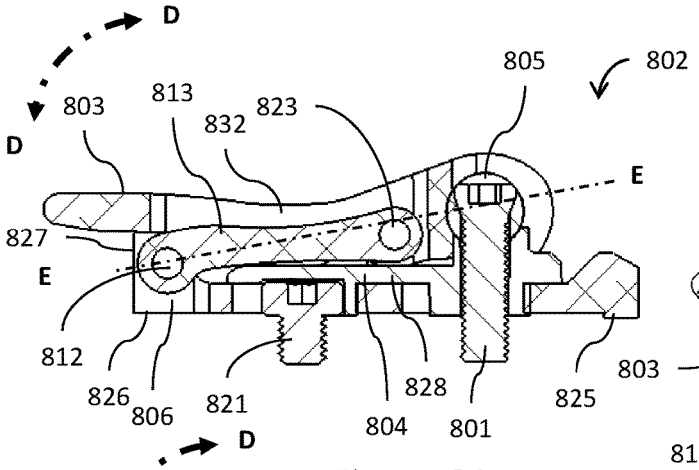
FIG. 9A is a cross sectional side view of a third example splitboard joining device tension element in a clamped configuration.
Figure 9B:
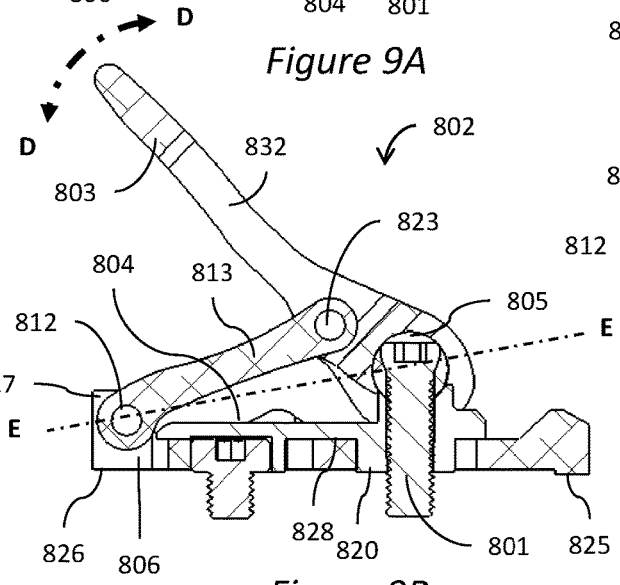
FIG. 9B is a cross sectional side view of a third example splitboard joining device tension element in an unclamped configuration.

FIG. 9A is a cross-sectional side view showing first attachment 802 in the clamped position displayed in FIG. 8A. FIG. 9B is a cross-sectional side view showing the first attachment 802 in the unclamped position displayed in FIG. 8B.

In some embodiments, first attachment 802 can have lever 803, barrel nut 805, mounting fastener 801, link 813, translational base portion 806, and fixed base portion 804. FIGS. 9D and 9E show exploded perspective views of first attachment 802 showing in more detail features of translational base portion 806 and fixed base portion 804.

Translational base portion 806 can further comprise angled clamping surface 808, shear tab 826, slot 819, rotational constraint slot 818, and link pivot 812. Link 813 can pivotally connect to lever 803 in slot 832 of lever 803 at link pivot 823 with a rivet, screw, pin or any similar cylindrical element for link 813 to rotate about. Slot 832 provides a double shear connection between link 813 and lever 803. Link 813 can pivotally connect to translational base portion 806 at link pivot 812 with a rivet, screw, pin or any similar cylindrical element for link 813 to rotate about. The connection at link pivot 812 can be a double shear connection.

Fixed base portion 804 can have vertical constraint surface 828 and a guide boss 820 which extends down from vertical constraint surface 828. Guide boss 820 can fit in slot 819 of translational base portion 806, extending a small amount past the bottom of translational base portion 806. With first attachment 802 attached to the first ski, guide boss 820 touches the top surface of the first ski with vertical constraint surface 828 constraining the vertical movement of translational base portion 806. Guide boss 820 further constrains the movement of translational base portion 806 to path C-C shown in FIG. 8B by having a tight fit between the width of guide boss 820 and the width of slot 819. Slot 819 is longer than guide boss 820, allowing translational base portion 806 to move along path C-C.

Translational base portion 806 can further comprise rotational constraint slot 818, which interacts with positioning attachment 821 (see FIG. 9A) to prevent rotation of first attachment 802 about mounting fastener 801. Positioning attachment 821 can be a screw.

Figure 9C:
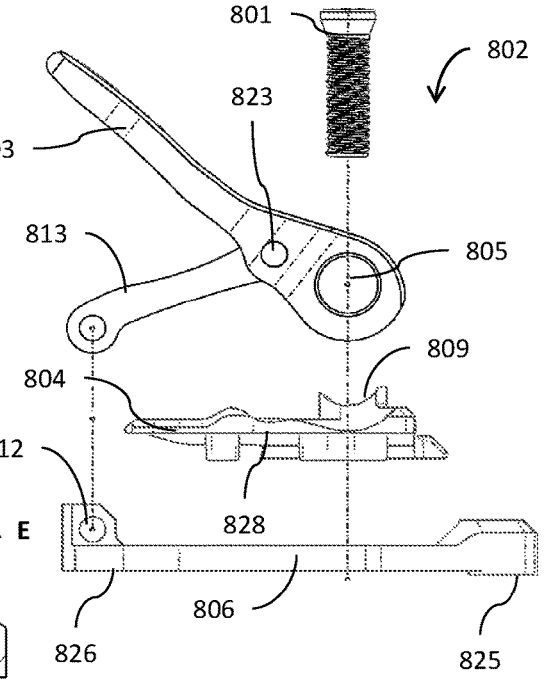
FIG. 9C is an exploded side view of a third example splitboard joining device tension element in an unclamped configuration.
Figure 9E:
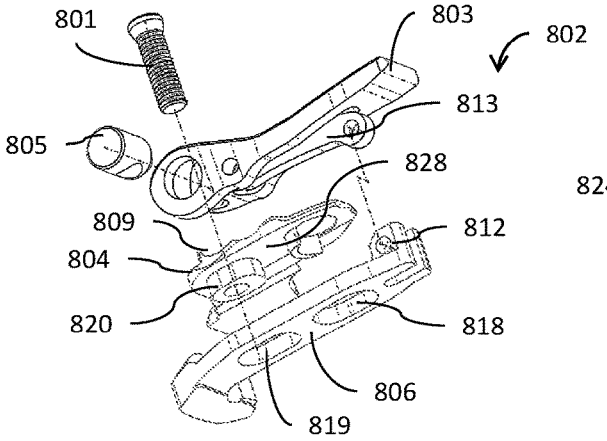
FIG. 9E is another exploded perspective view of a third example splitboard joining device tension element in an unclamped configuration.
Figure 9D:
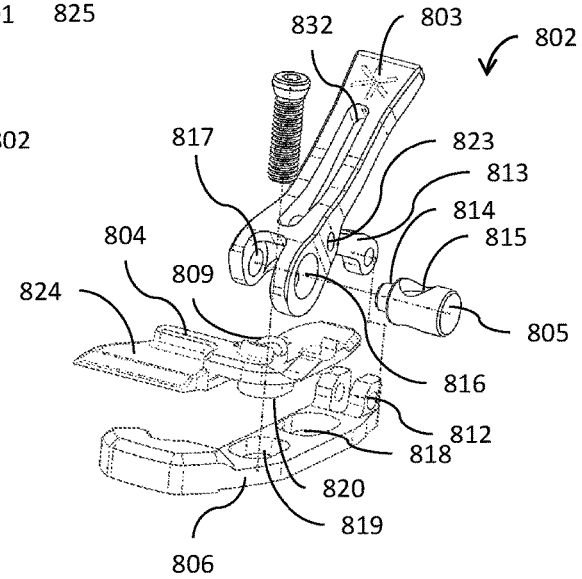
FIG. 9D is an exploded perspective view of a third example splitboard joining device tension element in an unclamped configuration.

FIG. 9C shows an exploded side view of first attachment 802. Lever 803 can be attached to link 813 through link pivot 823, and link 813 can be attached to translational base 806 through link pivot 812. Lever 803 can rotate about barrel nut 805 which can pass through pivot ear 816 and pivot ear 817 of lever 803 (see FIG. 9D). Barrel nut 805 can be configured to engage fixed base portion 804 through barrel nut receiving surface 809. Mounting fastener 801 can pass through barrel nut 805 and attach to first ski 101. Mounting fastener 801 can constrain barrel nut 805 in a vertical direction away from the top surface of first ski 101, with barrel nut 805 thus constraining fixed base portion 804 in a vertical direction and fixed base portion 804 thus constraining translational base portion 806 in a vertical direction. Mounting fastener 801 can clamp barrel nut 805 and fixed base portion 804 to the first ski 101 with the bottom surface of guide boss 820 of fixed base portion 804 contacting the first ski 101 and mounting fastener 801 threading into first ski 101. Barrel nut receiving surface 809 can be configured as a concentric surface to the diameter of the barrel nut 805 to provide maximum surface contact between the barrel nut 805 and fixed base portion 804.

Fixed base portion 804 can further comprise ramped clamping surface 824 which functions the same as ramped clamping surface 314 of FIGS. 3A through 5B. Translational base portion 806 can further comprise clamping element 825 and first ski contact surface 826. Clamping element 825 functions the same as clamping element 315 and first ski contact surface 826 functions the same as first ski contact surface 324 of FIGS. 3A through 5B. Splitboard joining device 800 creates the same clamping forces Fx, Fy and Fz as in splitboard joining device 300 as described in FIGS. 3A through 5B.

A difference between splitboard joining device 800 and splitboard joining device 300 is the rotation direction of lever 803 and lever 303. Lever 303 of splitboard joining device 300 rotates in a plane generally parallel to the top surface of the splitboard skis to move translational base portion 306. When lever 803 of first attachment 802 lifts in a direction generally normal to the top surface of first ski 101 and second ski 102 and pivots about barrel nut 805, lever 803 pulls translational base portion 806 by drive link 813. When lever 803 is lifted along path D in a plane generally perpendicular to the top surface of the first ski 101, translational base portion 806 is moved along path C into the unclamped position shown in FIG. 8B. Lever 803 can be lowered along path D. Lever 803 pushes translational base portion 806 by drive link 813 along path D to move translational base portion 806 into the clamped position as shown in FIG. 9A.

In some embodiments, link pivot 823 can move into an over-center position where link pivot 823 rests below over-center line E which passes through the center of link pivot 812 and barrel nut 805. In some embodiments, to move lever 803 from the lifted position shown in FIG. 9B link pivot 823 must pass through over-center line E. As link pivot 823 sits exactly on over-center line E in the illustrated embodiments, link pivot 812 and barrel nut 805 are at their farthest distance from each other pushing translational base portion 806 into its tightest clamped position with second attachment 301. Once link pivot 823 passes over-center line E the tension relaxes a small amount until lever 803 rests against lever stop 827 of translational base portion 806. In the over-center position, as force F is applied to translational base portion 806 and tension is increase between first attachment 802 and second attachment 301 through angled clamping surface 808, lever 803 rotates further into the clamped position because of the over-center position of link pivot 823, preventing lever 803 from popping open. To open lever 803, one must lift lever 803 with such force to overcome the force required to pass link pivot 823 back through over-center line E. Once link pivot 823 is above over-center line E, lever 803 will open more if force F is applied to angled clamping surface 808.

Figure 10:
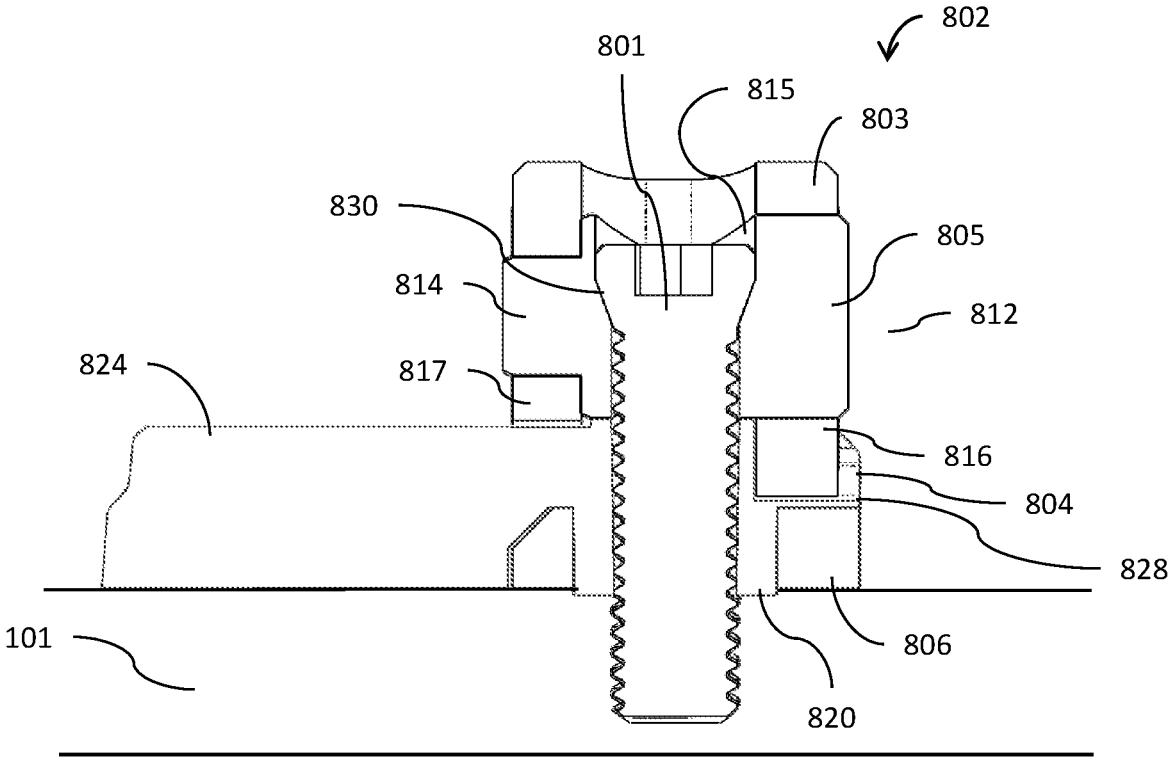
FIG. 10 is a sectional front view of a third example splitboard joining device tension element in a clamped configuration.
Figure 11:
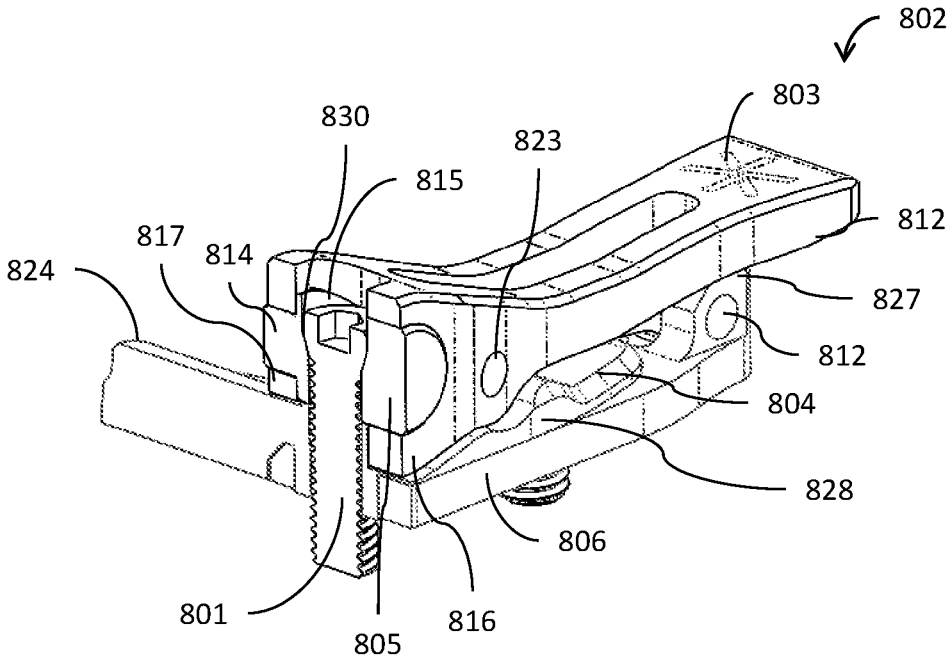
FIG. 11 is a sectional isometric view of a third example splitboard joining device tension element in a clamped configuration.

FIG. 10 shows a cross-sectional front view of first attachment 802 of splitboard joining device 800 showing the interfacing of lever 803, barrel nut 805, main fastener 801, fixed base portion 804 and translational base portion 806. FIG. 11 shows a cross-sectional perspective view of first attachment 802 of splitboard joining device 800.

As shown in FIGS. 10 and 11, barrel nut 805 can pass through lever 803 through pivot ear 816. Barrel nut 805 can also have stepped side 814 with a smaller diameter than the main portion of barrel nut 805. Stepped side 814 can pass through lever 803 through pivot ear 817. Main fastener 801 can pass through barrel nut 805 and engage barrel nut 805 with tapered surface 830 in counter bore 815 of barrel nut 805. Main fastener 801 can further extend through guide boss 820 of fixed base portion 804. Fixed base portion 804 can have guide boss 820 extend through translational base portion 806. Vertical constraint surface 828 can sit above translational base portion 806. Main fastener 801 can further thread into first ski 101 to fix first attachment 802 to first ski 101.

In some embodiments, pivot ear 817 can have a smaller diameter hole than pivot ear 816, allowing pivot ear 817 to be smaller than pivot ear 816. By pivot ear 816 being smaller than pivot ear 817, the height of 802 measured from the bottom of guide boss 820 to the top of lever 803 can be minimized. Ramped clamping surface 824 can extend from fixed base 804 and requires enough material thickness connecting to fixed base 804 to have a durable connection. If pivot ear 816 was the same size as pivot ear 817, the height of 802 measured from the bottom of the guide boss 820 to the top of lever 803 would be required to be higher to maintain the material thickness connecting ramped clamping surface 824 and fixed base portion 804.

The splitboard joining device and components thereof disclosed herein and described in more detail above may be manufactured using any of a variety of materials and combinations. In some embodiments, a manufacturer may use one or more metals, such as Aluminum, Stainless Steel, Steel, Brass, alloys thereof, other suitable metals, and/or combinations thereof to manufacture one or more of the components of the splitboard binding apparatus of the present disclosure. In some embodiments, the manufacturer may use one or more plastics to manufacture one or more components of the splitboard joining device of the present disclosure. In some embodiments, the manufacturer may use carbon-reinforced materials, such as carbon-reinforced plastics, to manufacture one or more components of the splitboard binding apparatus of the present disclosure. In some embodiments, the manufacturer may manufacture different components using different materials to achieve desired material characteristics for the different components and the splitboard joining device as a whole.

Conditional language such as, among others, "can," "could," "might," or "may," unless specifically stated otherwise, are otherwise understood within the context as used in general to convey that certain embodiments include, while other embodiments do not include, certain features, elements, and/or steps. Thus, such conditional language is not generally intended to imply that features, elements, and/or steps are in any way required for one or more embodiments.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require at least one of X, at least one of Y, and at least one of Z to each be present.

It should be emphasized that many variations and modifications may be made to the embodiments disclosed herein, the elements of which are to be understood as being among other acceptable examples. Accordingly, it should be understood that various features and aspects of the disclosed embodiments can be combined with or substituted for one another in order to form varying modes of the disclosed apparatus, systems, and methods. All such modifications and variations are intended to be included and fall within the scope of the embodiments disclosed herein. The present disclosure may be embodied in other specific forms without departing from its spirit or essential characteristics. The described embodiments are to be considered in all respects only as illustrative and not restrictive.

What is claimed is:

1. A splitboard joining device comprising:

a first attachment configured to attach to a first ski of a splitboard and not be removed from the first ski during normal operation;

a second attachment configured to attach to a second ski of a splitboard and not be removed from the second ski during normal operation;

a first tension element with a locked position and an unlocked position between the first attachment and the second attachment;

wherein at least the first attachment or the second attachment has a generally vertical clamping surface to engage the first tension element;

wherein the generally vertical clamping surface is in a plane that is greater than parallel to the seam of the splitboard and less than perpendicular to the seam of the splitboard.

2. The splitboard joining device of claim 1, wherein the first attachment comprises the first tension element and the second attachment comprises the generally vertical clamping surface.

3. The splitboard joining device of claim 2, wherein the second attachment comprises a second tension element configured to control tension applied by the first tension element in the locked position.

4. The splitboard joining device of claim 3, wherein the second tension element comprises a set screw configured to be movable on an axis that crosses the seam of the splitboard.

5. The splitboard joining device of claim 2, wherein the first tension element is configured to move in a plane generally parallel to the surface of the splitboard, and wherein the first tension element is driven by a lever.

6. The splitboard joining device of claim 1, wherein the first tension element uses a lever to increase and decrease tension.

7. The splitboard joining device of claim 1, wherein the second attachment is mounted to the second ski with at least two mounting fasteners oriented generally perpendicular to the seam of the splitboard, wherein the generally vertical clamping surface is oriented at an acute angle to the mounting fasteners.

8. The splitboard joining device of claim 1, wherein either the first attachment or the second attachment comprises a ramped surface configured to create a generally vertical clamping force between the first attachment and the second attachment.

* * * * *